US005909952A

United States Patent [19]

Guthrie et al.

[11] Patent Number: 5,909,952

[45] Date of Patent: Jun. 8, 1999

[54] FLASHING INDENTIFICATION LIGHT ADAPTOR SYSTEM FOR FLASHLIGHT

[75] Inventors: Phillip K. Guthrie; Charles A. Stundzia, both of Hilton Head Island, S.C.

[73] Assignee: TBI Concepts, L.L.C., Johns Island, S.C.

[21] Appl. No.: 08/842,852

[22] Filed: Apr. 17, 1997

Related U.S. Application Data

[63] Continuation-in-part of application No. 08/694,166, Aug. 8, 1996, Pat. No. 5,671,999.

[51] Int. Cl.[6] ..... F21L 1/00; F21L 15/04

[52] U.S. Cl. ..... 362/205; 362/184; 362/196; 362/202; 362/208; 362/293

[58] Field of Search ..... 362/184, 196, 362/197, 198, 202, 203, 205, 208, 293

[56] References Cited

U.S. PATENT DOCUMENTS

| | | | |
|---|---|---|---|
| 2,231,382 | 2/1941 | Desimone | 362/205 |
| 2,370,150 | 2/1945 | Dircksen | 362/202 |
| 2,493,491 | 1/1950 | MacMahon . | |
| 2,520,023 | 8/1950 | Allen . | |
| 2,530,913 | 11/1950 | Shackel | 362/205 |
| 2,538,332 | 1/1951 | Schaefer . | |
| 2,716,700 | 8/1955 | La France . | |
| 2,742,607 | 4/1956 | Ryan | 362/184 |
| 2,900,493 | 8/1959 | Cheng . | |
| 2,900,494 | 8/1959 | Cheng . | |
| 2,934,635 | 4/1960 | Cheng . | |
| 3,003,057 | 10/1961 | Cheng . | |
| 4,228,484 | 10/1980 | Johnstone | 362/202 |
| 4,527,223 | 7/1985 | Maglica . | |
| 4,905,130 | 2/1990 | Huang | 362/203 |
| 4,926,299 | 5/1990 | Gilson | 362/205 |
| 5,034,847 | 7/1991 | Brain | 362/208 |
| 5,091,611 | 2/1992 | Reeves et al. | 362/208 |
| 5,117,341 | 5/1992 | Huang | 362/205 |
| 5,197,796 | 3/1993 | Moore | 362/202 |
| 5,588,739 | 12/1996 | Nakao | 362/208 |
| 5,667,293 | 9/1997 | Own | 362/208 |
| 5,671,999 | 9/1997 | Guthrie et al. | 362/184 |

OTHER PUBLICATIONS

1993 Radio Shack Catalog, p. 93, specifically Item No. 61–2739, 3–in–1 fluorescent reading lamp, flashlight, warning blinker.

1996 Radio Shack Catalog, p. 159, specifically Item No. 61–2742, fluorescent lamp and spotlight.

*Primary Examiner*—Alan Cariaso

*Attorney, Agent, or Firm*—Litman, Kraai and Brown, L.L.C.

[57] ABSTRACT

A flashing identification light adaptor system includes a flashing light adaptor with an adaptor housing which is intended to replace the end cap of a conventional flashlight and includes a colored lens removably attached to the adaptor housing in a covering relationship with a light source, which may be a flasher circuit and lamp connected to an independent switch. The flashing light adaptor can include a housing with a dedicated switch, a strobe light and a flasher circuit housed therein and a battery cell holding sleeve such that a battery cell or cells within the sleeve are used to selectively power the flashing light and/or the conventional flashlight bulb.

12 Claims, 3 Drawing Sheets

FLASHING INDENTIFICATION LIGHT ADAPTOR SYSTEM FOR FLASHLIGHT

CROSS-REFERENCE TO RELATED APPLICATION

This application is a continuation-in-part of application Ser. No. 08/694,166, also entitled FLASHING IDENTIFICATION LIGHT ADAPTOR SYSTEM FOR FLASHLIGHT, filed Aug. 8, 1996, now U.S. Pat. No. 5,671,999.

BACKGROUND OF THE INVENTION

I. Field of the Invention

The present invention relates to an flashing identification light adaptor system for a flashlight, and, more particularly, to such an adaptor system which includes an adaptor housing which is designed to replace the threaded end cap of a conventional flashlight. The adaptor system uses the existing batteries of the flashlight for electrical power, yet is switched independently of the flashlight itself.

II. Description of the Related Art

Police, firemen and other emergency personnel use flashlights for a variety of reasons, including conventional illumination as well as providing an emergency beacon which allows them to be more easily seen and identified. A tubular multi-cell flashlight made and sold under the MAG trademark has found wide spread use among emergency personnel for its varifocal lens, its durability and resistance to moisture. Such flashlights are generally available with clear lenses and conventional bulbs. However, certain emergency personnel are widely identified with specific colors. For example, police are internationally recognized to use blue as an emergency color while firemen and emergency medical technicians use red. Other emergency personnel, such as tow truck operators, use yellow. Furthermore, it is well known that flashing lights attract greater attention than steady lights.

It is clear then, that a need exists for an attachment which would allow emergency personnel to utilize a conventional flashlight, such as the MAG light mentioned above, to provide independently controlled, colored, flashing light as well.

SUMMARY OF THE INVENTION

The present invention is directed to a flashing identification light adaptor system for a flashlight which includes an adaptor housing which is intended to replace the end cap of a conventional flashlight. The housing includes male threads adapted to mate with the existing end cap female threads on the flashlight. The attachment includes a colored lens removably attached to the adaptor housing in covering relationship with a light source, which may be a lamp controlled by a flasher circuit. An insulated flat conductor is positioned within the flashlight barrel to make contact with the positive battery terminal of the flashlight and the flat conductor connects to a remote positive terminal positioned proximate the end cap threads within the flashlight barrel. The attachment includes a coil spring for making contact with the negative battery terminal within the flashlight and a positive connector is positioned alongside, but insulated from, the coil spring in a position to be aligned with the remote positive terminal when the adaptor is threadably engaged with the flashlight barrel. A pair of indicia arrows can be provided, one on the adaptor housing exterior and one on the flashlight barrel exterior, to give a positive indication of alignment and contact between the positive connector and remote positive terminal when the housing is threaded onto the flashlight barrel.

The positive connector is connected to one terminal of a switch, which may be a slide or push button switch. A second terminal of the switch is connected to a flasher circuit, which circuit provides an intermittent voltage to a lamp in a known fashion. The opposite terminal of the lamp is connected to the coil spring.

A specifically colored identification flashing light adaptor can be provided or a plurality of complete flashing light attachments with accompanying, differently colored lenses can be provided as a kit. As an alternative, the colored lens can be made exchangeable for other, specially colored lenses for specific use by different emergency personnel, as described above.

In a first alternative embodiment, the flashing light adaptor includes a housing with a dedicated switch, a strobe light and a flasher circuit housed therein. As in the first embodiment, the housing is adapted to threadably engage a flashlight barrel to replace the end cap on a flashlight. A battery holding sleeve is attached to and extends outward from the housing and an insulated conductor extends along the sleeve from the housing to a sleeve battery terminal where it is connected to a positive battery terminal. The sleeve is sized to accommodate a single battery with the combination of the sleeve and battery sized to replace one of the batteries in the flashlight barrel. The dedicated switch in the flashing light adaptor housing allows the strobe light to be powered alone via the single battery or together with the flashlight, but also via the single battery.

In a second alternative embodiment, the flashing light adaptor includes a housing with a dedicated switch, a strobe light and a flasher circuit housed therein which housing is also adapted to threadably engage a flashlight barrel to replace the end cap on a flashlight. A battery holding sleeve is attached to and extends outward from the housing and an insulated conductor extends along the sleeve from the housing to a sleeve battery terminal at an opposite end of the sleeve where it is connectable to a positive terminal of a last of multiple batteries in the sleeve. The combination of the sleeve and batteries is sized to accommodate two or three, or more, battery cells, depending upon the flashlight design, with the sleeve and batteries sized to replace all of the batteries in the flashlight barrel. The dedicated switch in the flashing light adaptor housing allows the strobe light to be powered alone via the multiple batteries in the sleeve or together with the flashlight, with both flashlight and strobe light powered by all of the batteries.

OBJECTS AND ADVANTAGES OF THE INVENTION

Some of the principle objects and advantages of the invention are: to provide a flashing identification light adaptor system for a flashlight; to provide such an adaptor system which is designed to replace the threaded end cap of a conventional flashlight; to provide such an adaptor system which includes a adaptor housing with a colored lens in covering relationship with a flashing lamp; to provide such an adaptor system in which the lens can be specially colored for enhanced visibility and for use by specific emergency personnel; to provide such an adaptor system which is powered by the existing batteries in the flashlight; to provide such an adaptor system which is separately switched from the flashlight; and to provide such an adaptor system which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
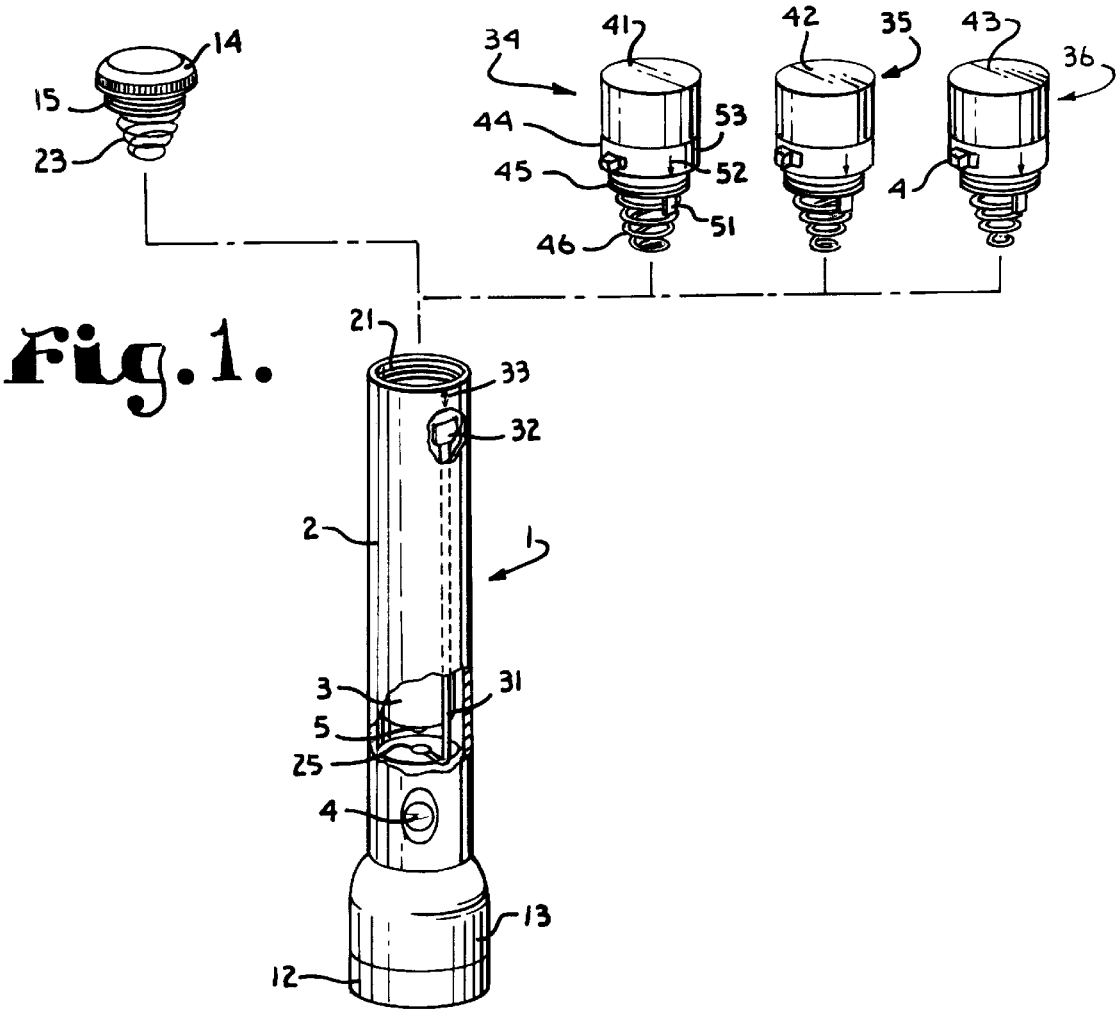
FIG. 1 is an exploded view of the flashing identification light adaptor system for a flashlight in accordance with the present invention, illustrating three differently colored adaptors for a single flashlight.
Figure 2:
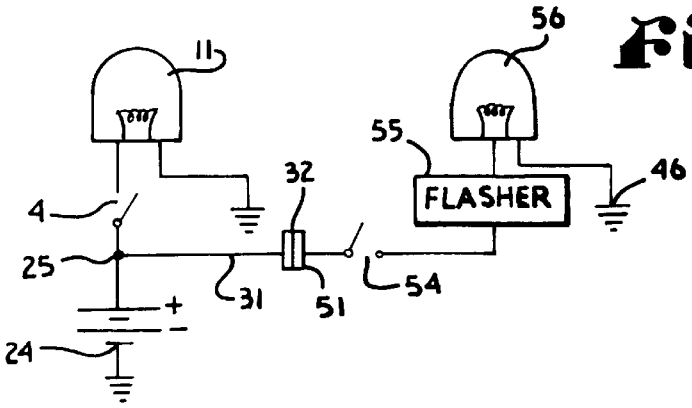
FIG. 2 is a representative electrical schematic diagram of the flashlight of FIG. 1 with the inventive flashing identification light adaptor system connected thereto.

FIG. 1 illustrates a multiple cell tubular flashlight 1 similar to flashlights manufactured and sold under the MAG trademark. The flashlight 1 includes a conventional tubular barrel 2 adapted to hold a number of batteries 3 placed end to end in electrical series. A push button switch 4 selectively connects a positive terminal 5 of the batteries 3 to a flashlight bulb 11. The flashlight 1 includes a variable focus lens 12 controlled by a rotating lens housing 13. An end cap 14 with male threads 15 mates with female threads 21 in an end of the barrel 2. The end cap 14 includes a coil spring 23 which contacts a negative terminal 24 of the batteries 3 to urge them inward to make secure contact between the battery terminal 5 and a flashlight positive terminal 25.

The flashlight 1 as described to this point is entirely conventional. In order to adapt the flashlight 1 to accommodate the inventive flashing identification light adaptor system, an insulated flat conductor 31 is connected to the positive terminal 25. The flat conductor 31 is then extended along the interior of the barrel 2 to a remote positive terminal 32 which itself is insulated from the barrel 2.

The flashlight 1 can be further modified to include an indicia arrow 33 on the exterior of the barrel 2 which arrow 33 is preferably aligned with the positive terminal 32.

A plurality of flashing identification light adaptors 34, 35 and 36 are illustrated in FIG. 1. The flashing identification light adaptor 34 includes a red lens 41, the attachment 35 includes a yellow lens 42 and the attachment 36 includes a blue lens 43. The flashing light adaptors 34–36 can be marketed singly with specific colors or collectively as a kit. As an alternative, the colored lenses 41–43 can be made interchangeable so that a single flashing light adaptor, such as the adaptor 34, can be changed to various colors. The adaptors 34–36 are otherwise identical and thus only adaptor 34 will be further described.

The adaptor 34 includes an adaptor housing 44 which is intended to replace the end cap 14 and includes male threads 45 adapted to mate with the female threads 21 in the barrel 2. The housing 44 also threadably engages the colored lens 41. A coil spring 46 is provided on the housing 44 to contact the negative terminal 24 of the batteries 3 and urge the positive battery terminal 5 into contact with the flashlight positive terminal 25. The flat conductor 31, when the adaptor housing 44 is threadably seated on the barrel 2, thus provides a connection between the positive battery terminal 5 and the remote positive terminal 32. A positive connector 51 is positioned alongside, but insulated from, the coil spring 46. An indicia arrow 52 can be placed on an exterior ring 53 of the housing 44 in alignment with the positive terminal 32. As the adaptor 34 is screwed into the barrel 2, by aligning the indicia arrow 52 with the indicia arrow 33, a user can be assured of an adequate connection between the battery positive terminal 5 and the adaptor 34. Of course, the indicia arrows 33 and 52 can be located anywhere around the upper periphery of the barrel 2 and the ring 53 of the housing 44 as long as they are aligned when the remote positive terminal 32 is in contact with the positive connector 51.

The positive connector 51 is connected to one terminal of a switch 54, shown here as a slide switch. A second terminal of the switch 54 is connected to a flasher circuit 55 which is connected to and controls a lamp 56. The flasher circuit 55, when connected to a source of DC voltage, causes the lamp 56 to intermittently flash on and off in a known manner. The opposite terminal of the lamp 56 is connected to the coil spring 46.

Figure 3:
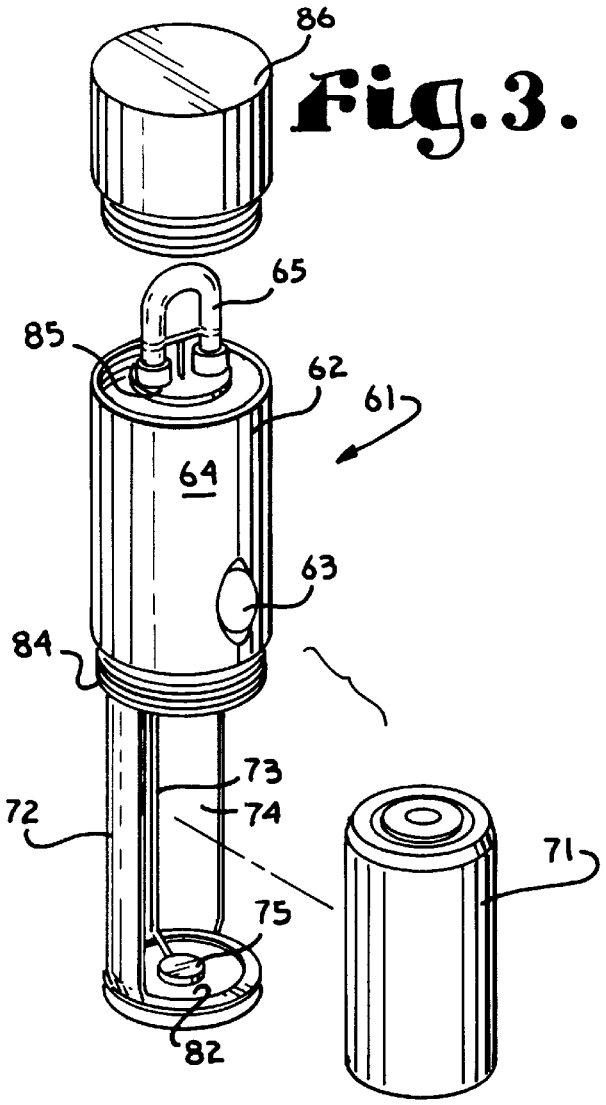
FIG. 3 is an exploded view of a first alternative embodiment of flashing identification light adaptor system for a flashlight, with a single battery cell holding sleeve.

Referring to FIG. 3, a first alternative embodiment of flashing identification light adaptor for a flashlight is illustrated, and generally indicated at numeral 61. The adaptor 61 includes a housing 62 with a dedicated push to make switch 63 positioned in a cylindrical wall 64 of the housing 62. A strobe light 65, which can be, for example, a Xenon lamp, is attached to and extends outward from a terminal end of the housing 62, with the strobe light 65 being powered by a single "D cell" battery 71 positioned within a semi-cylindrical single battery cell holding sleeve 72. The sleeve 72 is attached to and extends outward from the housing 62 and an insulated conductor 73 extends along an interior surface 74 of the sleeve 72 from the switch 63 to a sleeve battery terminal 75. The battery terminal 75 includes a conductive button positioned within a plastic or other insulating disc 82 such that the terminal 75 is insulated form the remainder of the sleeve 72. An opposite side of the terminal 75 (not shown) is in position to contact a second "D" cell within the flashlight barrel 2 when the housing 62 is threadably engaged with the barrel 2, as explained below.

As in the embodiment of FIG. 1, the housing 62 is designed to replace the conventional end cap 14 of the flashlight 1, and is thus equipped with external male threads 84 which mate with existing internal female threads 21 in the barrel 2. A flashing circuit, generally indicated at 85, is connected between the switch 63 and the strobe light 65. A removable threaded colored lens 86 is attachable to the housing 62 in covering relation to the strobe lamp 65.

Figure 5:
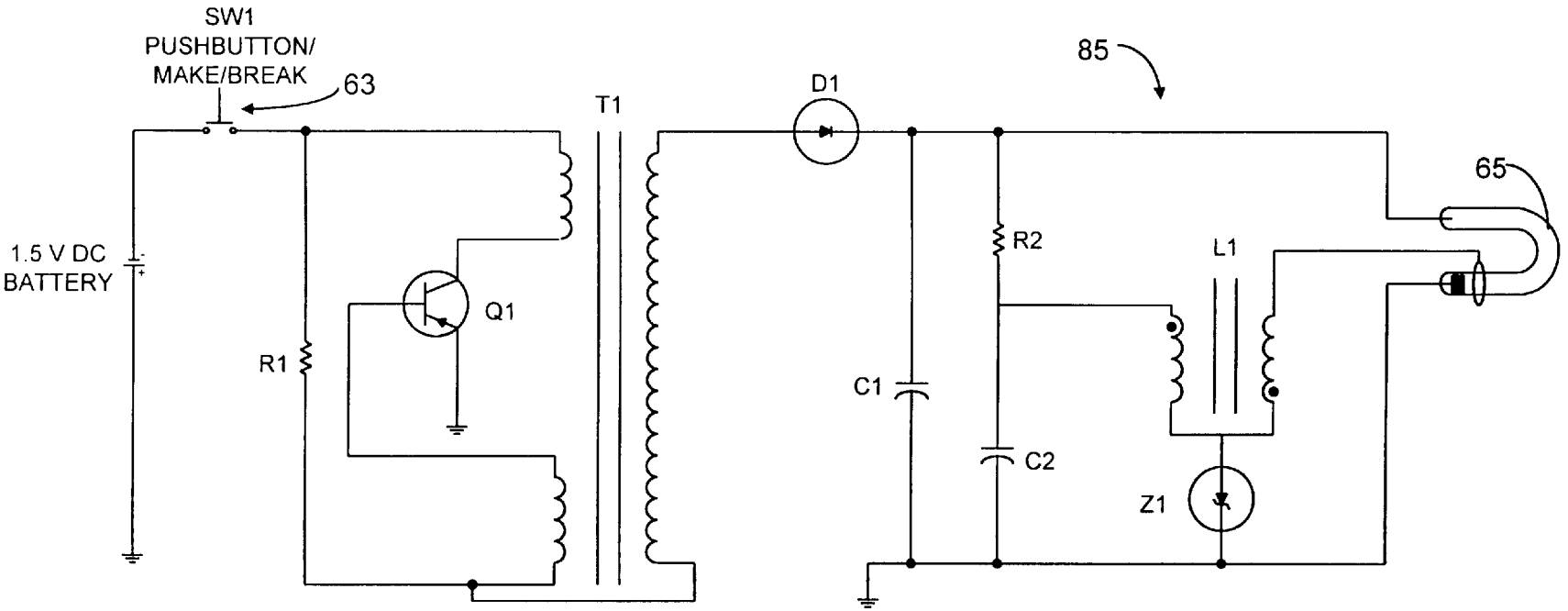
FIG. 5 is a representative electrical schematic diagram of the flashing identification light adaptor system of FIG. 3.

Referring to FIG. 5, one example of a suitable flashing circuit 85 is illustrated. The circuit 85 includes a resistor R1, a bipolar PNP transistor Q1 and a step-up transformer T1, collectively acting as a DC-AC convertor and voltage enhancer. Stepped up voltage from a secondary coil of the transformer T1 is rectified by a diode D1 and supplied to a capacitor C1 and a first terminal of the Xenon strobe lamp 65. Opposing terminals of the capacitor C1 and the Xenon strobe lamp 65 are connected to ground. A series connection of a second capacitor C2 and a resistor R2 is applied across the capacitor C1, and a triggering transformer L1 has a first terminal connected between the capacitor C2 and the resistor R2. A zener diode Z1 is connected to a second terminal of the triggering transformer L1 and a third terminal of the triggering transformer L1 is connected to a triggering input of the strobe lamp 65. As the capacitor C2 is charged, it reaches a breakdown voltage for the zener diode Z1, which then breaks down to trigger a discharge triggering pulse from the triggering transformer L1 to the strobe lamp 65. With the triggering pulse applied to the lamp 65, current from the capacitor C1 passes through the lamp 65, causing it to momentarily light up. By changing the resistance of the resistor R2, the charging rate of the capacitor C2 can be varied, thus varying the flash rate of the flash circuit 85. Alternatively, a variable resistor (not shown) can be substituted for the resistor R2 to allow the flash rate to be adjustable.

The switch 63 allows the strobe light 65 to be powered alone via the single battery cell 71 or simultaneously with the flashlight 1, but also via the single battery cell 71 while the flashlight 1 is powered via the cell 71 in series combination with other battery cell or cells (not shown) in the barrel 2.

Figure 4:
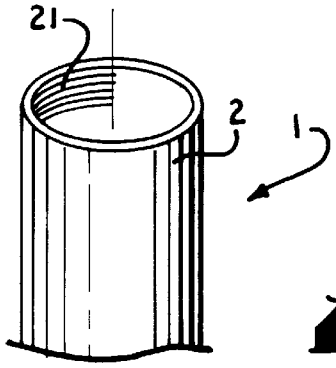
FIG. 4 is an exploded view of a second alternative embodiment of flashing identification light adaptor system for a flashlight, with a multiple battery cell holding sleeve.
Figure 4:
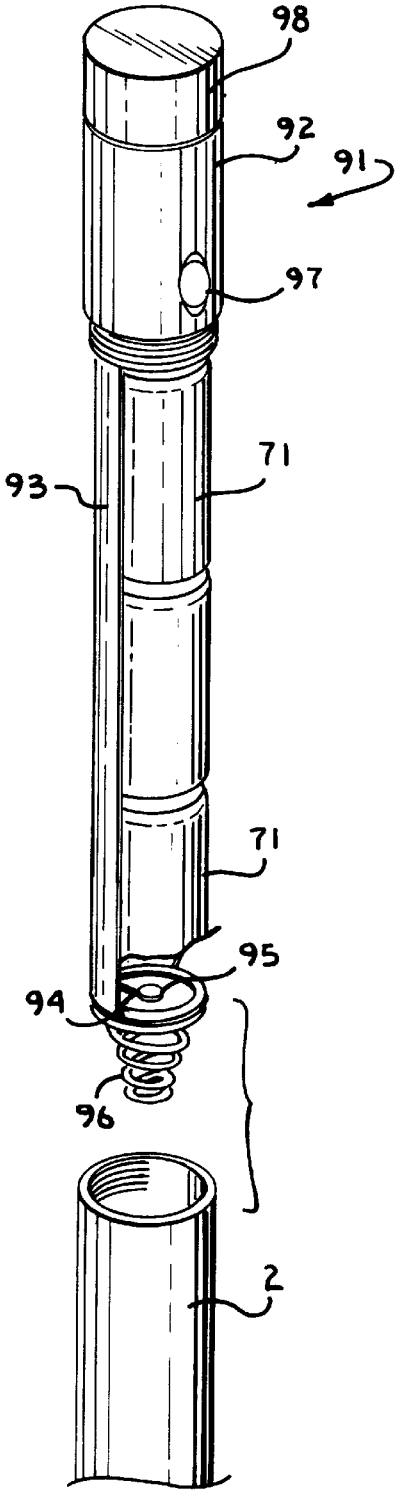

FIG. 4 illustrates a second alternative embodiment of flashing identification light adaptor, generally indicated at 91. The adaptor 91 is similar in all respects to the adaptor 61 except that a housing 92 is connected to a battery cell holding sleeve 93 which is elongated to hold three battery cells 71, which can comprise all of the battery cells 71 in the flashlight 1. An insulated conductor 94 extends the length of the sleeve 93 to a positive battery terminal 95, which, again, includes an insulated conductive button. A conductive spiral spring 96 is attached to a bottom side (not shown) of the terminal 95, and the spring 96 is positioned to contact a positive battery terminal within the barrel 2 of the flashlight 1. A push to make and break switch 97 in the flashing light adaptor 91 connects to the adaptor housing 92 to allow the strobe light (not shown in FIG. 4) to be powered alone via the multiple battery cells 71 or simultaneously with the flashlight 1, with both the flashlight 1 and the strobe light powered via the series connected battery cells 71. A colored lens 98, which can be any desired color including, without limitation, red, blue or yellow, is removably attachable to the housing 92. With both of the adaptors 61 of FIG. 3 and 91 of FIG. 4, no alignment is required between the adaptor housings 62 and 92 and the flashlight barrel 2, thus no alignment indicia is necessary.

It should be noted that, with respect to FIG. 1, although arrows 33 and 52 have been shown as aligning indicia, other indicia designs could be used with equal effectiveness. Furthermore, while the conductor 31 is shown as separate from the barrel 2, it could be imbedded into a groove within the interior of the barrel 2, if desired. Although the lamps 56 and 65 have been shown as connected directly to the flasher circuit 55, alternative connections could be devised to allow for a steady illumination of colored lights.

With respect to FIGS. 3–5, the use of a Xenon lamp 65 is representative only, and other types of high intensity lamps can be used effectively. The flashing circuit 85 is but one example of a myriad of circuit designs which can be used to provide intermittent power to a high intensity flashing light source. Representative components of the flashing circuit 85 are:

R1: 330 OHM resistor;
R2: 3.9 Meg Ohm resistor;
Q1: 2SB772 Transistor;
D1: 1n4004 Diode;
T1: M8149 Transformer;
C1: 10 $\mu$F 250V Capacitor;
C2: 0.01 $\mu$F 250V Capacitor;
L1: 422-1304 Transformer;
Z1: K2000F1 Zener Diode;
Lamp 65: 891-1581 Xenon strobe.

The present invention, as shown in any of the drawing FIGS. 1–5 is usable with any standard flashlight and is not limited to use with MAG flashlights.

It is thus to be understood that while certain forms of the present invention have been illustrated and described herein, it is not to be limited to the specific forms or arrangement of parts described and shown.

What is claimed and desired to be secured by Letters Patent is as follows:

1. A flashing light adaptor system which is connectable to a flashlight equipped with an end cap with threads mating with cooperating threads in a barrel of the flashlight, the end cap contacting a first terminal of a battery and urging an opposite terminal of the battery into electrical contact with a switch terminal in the barrel, said flashing light adaptor system comprising:

a. an adaptor housing adapted to replace said end cap, said adaptor housing being equipped with threads mating with the cooperating threads in the flashlight barrel;

b. a flashing light source positioned within said adaptor housing;

c. a battery cell holding sleeve attached at a first end to said adaptor housing, said holding sleeve including a battery terminal at a second end opposite to said first end, said sleeve being sized to accommodate at least one battery cell and having an outer diameter which is smaller than an inner diameter of the flashlight barrel such that the entire sleeve fits within the flashlight barrel, said sleeve battery terminal being positioned where it is placed in electrical contact with the flashlight switch terminal when said adaptor housing is threadably engaged with the flashlight barrel;

d. a switch selectively connecting the sleeve battery terminal to said flashing light source; and e. a colored lens positioned in covering relation with said flashing light source.

2. A flashing light adaptor system as in claim 1, and further comprising:

a. an insulated conductor extending along said sleeve and which is connected between said sleeve battery terminal and said switch.

3. A flashing light adaptor system as in claim 1, and wherein said light source comprises:

a. a flasher circuit which includes circuitry which produces an intermittent voltage on an output lead in response to a DC voltage placed on an input lead; and b. a lamp attached to said flasher circuit output lead.

4. A flashing light adaptor system as in claim 3, wherein said lamp is a Xenon strobe lamp.

5. A flashing light adaptor system as in claim 1, wherein said sleeve is sized to accommodate a single battery cell and the electrical connection from said sleeve battery terminal to said flashlight switch terminal is via additional battery cell or cells in the flashlight barrel, said flashing light adaptor system being powered via said single battery cell regardless of how many battery cells in the flashlight.

6. A flashing light adaptor system as in claim 1, wherein said sleeve is sized to accommodate all of the battery cells in the flashlight barrel such that said flashing light adaptor system is powered via a series connection of all of said battery cells.

7. A flashing light adaptor system which is connectable to a flashlight equipped with an end cap with threads mating with cooperating threads in a barrel of the flashlight, the end cap contacting a first terminal of a battery and urging an opposite terminal of the battery into electrical contact with a switch terminal in the barrel, said flashing light adaptor system comprising:

a. an adaptor housing adapted to replace said end cap, said adaptor housing being equipped with threads mating with the cooperating threads in the flashlight barrel;

b. a flashing light source positioned within said adaptor housing;

c. a battery cell holding sleeve attached at a first end to said adaptor housing, said holding sleeve including a battery terminal at a second end opposite to said first end, said sleeve being sized to accommodate a single battery cell and having an outer diameter which is smaller than an inner diameter of the flashlight barrel such that the entire sleeve fits within the flashlight barrel, said sleeve battery terminal being positioned where it is placed in electrical contact with additional battery cells within the flashlight barrel when said adaptor housing is threadably engaged with the flashlight barrel;

d. a switch selectively connecting the sleeve battery terminal to said flashing light source such that said flashing light adaptor system is powered via said single battery cell regardless of how many total battery cells are in the flashlight;

e. an insulated conductor extending along said sleeve and which is connected between said sleeve battery terminal and said switch; and f. a colored lens positioned in covering relation with said flashing light source.

8. A flashing light adaptor system as in claim 7, and wherein said light source comprises:

a. a flasher circuit which includes circuitry which produces an intermittent voltage on an output lead in response to a DC voltage placed on an input lead; and b. a lamp attached to said flasher circuit output lead.

9. A flashing light adaptor system as in claim 8, wherein said lamp is a Xenon strobe lamp.

10. A flashing light adaptor system which is connectable to a flashlight equipped with an end cap with threads mating with cooperating threads in a barrel of the flashlight, the end cap contacting a first terminal of a series of battery cells and urging an opposite terminal of the battery cell series into electrical contact with a switch terminal in the barrel, said flashing light adaptor system comprising:

a. an adaptor housing adapted to replace said end cap, said adaptor housing being equipped with threads mating with the cooperating threads in the flashlight barrel;

b. a flashing light source positioned within said adaptor housing;

c. a battery cell holding sleeve attached at a first end to said adaptor housing, said holding sleeve including a battery terminal at a second end opposite to said first end, said sleeve being sized to accommodate all of the battery cells in said series and having an outer diameter which is smaller than an inner diameter of the flashlight barrel such that the entire sleeve fits within the flashlight barrel, said sleeve battery terminal being positioned where it is placed in electrical contact with the flashlight switch terminal when said adaptor housing is threadably engaged with the flashlight barrel;

d. a switch selectively connecting the sleeve battery terminal to said flashing light source such that said flashing light adaptor system is powered via said series of battery cells;

e. an insulated conductor extending along said sleeve and which is connected between said sleeve battery terminal and said switch; and f. a colored lens positioned in covering relation with said flashing light source.

11. A flashing light adaptor system as in claim 10, and wherein said light source comprises:

a. a flasher circuit which includes circuitry which produces an intermittent voltage on an output lead in response to a DC voltage placed on an input lead; and b. a lamp attached to said flasher circuit output lead.

12. A flashing light adaptor system as in claim 11, wherein said lamp is a Xenon strobe lamp.

* * * * *

UNITED STATES PATENT AND TRADEMARK OFFICE

CERTIFICATE OF CORRECTION

PATENT NO. : 5,909,952
DATED : June 1, 1999
INVENTOR(S) : Shipman

It is certified that error appears in the above-identified patent and that said Letters Patent is hereby corrected as shown below:

Title page,
Item [57], ABSTRACT, delete “recognizineg” and insert -- recognizing --.

Signed and Sealed this

Thirteenth Day of July, 2004

JON W. DUDAS
*Acting Director of the United States Patent and Trademark Office*